United States Patent [19]

Kamiyama

[11] 4,399,383

[45] Aug. 16, 1983

[54] GASOLINE RESISTANT COMMUTATOR

[75] Inventor: Akira Kamiyama, Kiryu, Japan

[73] Assignee: Mitsuba Electric Mfg. Co., Ltd., Gumma, Japan

[21] Appl. No.: 234,938

[22] Filed: Feb. 17, 1981

Related U.S. Application Data

[62] Division of Ser. No. 969,277, Dec. 13, 1978, Pat. No. 4,283,841.

[30] Foreign Application Priority Data

Jan. 26, 1978 [JP] Japan ..... 53-6680
Jul. 20, 1978 [JP] Japan ..... 53-100447

[51] Int. Cl.[3] ..... H02K 13/04
[52] U.S. Cl. ..... 310/233; 310/236; 29/597
[58] Field of Search ..... 310/87, 88, 43, 45, 310/44, 54, 57, 233–237, 219, 232; 417/366; 174/138; 29/597; 307/7, 8

[56] References Cited

U.S. PATENT DOCUMENTS

| | | | |
|---|---|---|---|
| 842,829 | 1/1907 | Duncan | 29/597 |
| 1,901,955 | 3/1933 | Giaimo | 29/597 |
| 3,005,920 | 10/1961 | Dolza | 29/597 |
| 3,129,349 | 4/1964 | Ervin | 310/234 |
| 3,418,991 | 12/1968 | Shultz et al. | 417/366 |
| 3,656,130 | 4/1972 | Lilley | 310/234 |
| 4,035,908 | 7/1977 | Ishi et al. | 29/597 |
| 4,188,713 | 11/1977 | Kawano et al. | 29/597 |

FOREIGN PATENT DOCUMENTS

| | | | |
|---|---|---|---|
| 1938322 | 2/1971 | Fed. Rep. of Germany | 310/233 |

*Primary Examiner*—R. Skudy
*Attorney, Agent, or Firm*—Fidelman, Wolffe & Waldron

[57] ABSTRACT

The present invention relates to a commutator which is always exposed to gasoline in a motor to drive, for example, a fuel pump of an automobile or the like and the method of efficiently producing the commutator. A good conductive sheet, the wear of which is not promoted by oxidized gasoline, is fixed to the surface of each commutator segment made of copper or copper alloy at least at the part to contact a brush.

14 Claims, 15 Drawing Figures

GASOLINE RESISTANT COMMUTATOR

This is a divisional of application Ser. No. 969,277, filed Dec. 13, 1978, now U.S. Pat. No. 4,283,841.

SUMMARY OF THE INVENTION

The present invention relates to a commutator of a motor for, e.g., a fuel pump of an automobile or the like.

A commutator of a small motor to drive a fuel pump is exposed to gasoline flowing through the motor. The life of such a commutator is shorter than that of one used in air. The reason will be mentioned hereinafter.

Commutator segments are generally made of copper or copper alloy. When a commutator is used in air, the copper surface of each commutator segment is covered with an oxidized film made by the contact with brushes. However, when the commutator is used in gasoline, such an oxidized film is not made, and thus the copper surface is always exposed to gasoline. Gasoline oxidizes under the influence of copper, and oxidized gasoline promotes the wear of copper. Therefore, the copper surface exposed to gasoline will wear much earlier than that of a commutator used in air.

The first object of the present invention is to provide a commutator for extended use in gasoline, in which gasoline induced wear of the commutator is greatly decreased.

In order to attain the abovementioned object, the following methods have been employed. In one prior method, commutator segments are totally made of silver. In another method, a fuel pump driving motor is isolated from the gasoline so that the commutator is not exposed to gasoline. These methods, however, have the defect that the products are expensive, since a precious metal, silver, is used in large quantities in the former method, and the structure is complex in the latter method.

The second object of the present invention is to provide a commutator of low cost.

The third object of the present invention is to provide a method of efficiently producing the commutator which can attain the first and second objects.

The present invention is characterized in a commutator having a sheet fixed to the surface of each copper or copper alloy commutator segment, at least covering the part contacted by a brush; the sheet is made of a good conductive material of which the wear is not promoted by oxidized gasoline.

Other objects and features of the present invention will be apparent from the following detailed description of the invention.

BRIEF DESCRIPTION OF THE DRAWING

FIG. 1A is a perspective view of a blanked plate used in the manufacture of conventional commutator segments;

FIG. 1B is a perspective view of a cylinder formed by rounding the blanked plate of FIG. 1A;

FIG. 1C is a perspective view, partially in section, of the conventional commutator;

FIG. 4A is a perspective view of a pressure-welded plate;

FIG. 4B is a perspective view of a plate blanked from the welded plate of FIG. 4A;

FIG. 5A is a perspective view of a blanked plate;

FIG. 5B is a perspective view of the blanked plate of FIG. 5A with a sheet of silver or silver alloy fixed thereto by means of silver-alloy brazing;

DETAILED DESCRIPTION OF THE INVENTION

The present invention will be described hereinafter in accordance with the accompanying drawings.

Figure 1A:
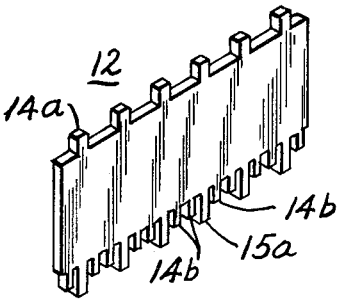
FIGS. 1A, 1B and 1C show the structure and the producing processes of a conventional commutator.
Figure 1B:
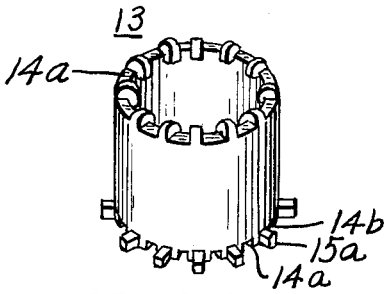
PRIOR ART FIG.1B
Figure 1C:
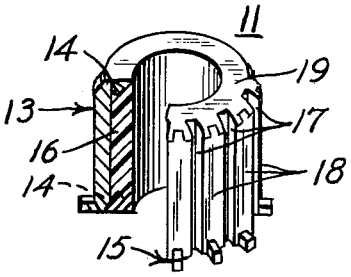
PRIOR ART FIG.1C

FIGS. 1A, 1B and 1C show a conventional commutator for comparison with the commutator of the present invention and the producing processes thereof.

In general, commutator segments are made of thin copper plates. A copper plate 12 of the shape shown in FIG. 1A is obtained by means of blanking. The blanked plate 12 is rounded into a cylinder 13 as shown in FIG. 1B. Prior to that, a plurality of pawls **14*a* and 14*b* protruding beyond the top and the bottom of the plate 12 are bent inwardly of the cylinder 13, and projections 15*a* disposed between the pawls 14*b* are bent outwardly of the cylinder 13. As shown in FIG. 1C, a thick cylinder 16 of resin is molded by compression on the inner surface of the cylinder 13. The cylinder 13 is tightly joined with the resin cylinder 16 at positions 14 through the pawls 14*a* and 14*b*. Finally, a suitable number of slits 17 are provided on the outer surface of the cylinder 13** at regular intervals.

A conventional commutator 11 is manufactured as mentioned above. The part between each slit 17 is a commutator segment 18. The slit 17 is a segment mica. The resin cylinder 16 is a commutator sleeve 19. The projections **15*a* are commutator risers 15**.

Figure 2:
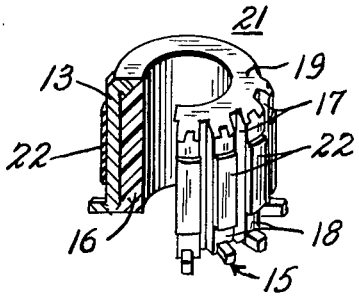
PRIOR ART FIG.2
FIG. 2 is a perspective view of a commutator in the first embodiment of the present invention.

FIG. 2 is a perspective view showing a commutator in the first embodiment of the present invention. The commutator 21 has sheets 22, of 0.4–1.2 mm in thickness, fixed to the surface of each copper commutator segment 18. The sheets 22 are made of a good conductive material of which the wear is not promoted by oxidized gasoline. The material is, for example, silver, alloy of silver and palladium, or an alloy of silver, palladium and other metals. The area covered with each sheet 22 is at least the part to be contacted by brushes.

Brushes contact only the sheets 22 and grind them. Namely, only the sheets 22 are worn by brushes. Though oxidized gasoline promotes the wear of copper, it does not promote the wear of silver or silver alloy. Therefore, the wear of the sheets 22 made of silver or silver alloy is very less than that of the conventional commutator segments as shown in FIG. 1C. The wear of the sheets is approximately the same as that of the conventional commutator segments used in air (not in gasoline). When both commutators were used in gasoline, the life of the commutator 21 with the sheets 22 was about 10 to 15 times as long as that of the conventional commutator 11.

Because precious silver or silver alloy is used only for the sheets 22 partly covering the surface of each commutator segment, the commutator is less expensive. Moreover, since the commutator 21 with the sheets 22 can be used in gasoline for a long time, a motor using this commutator need not be placed separately from a fuel pump.

In the commutator 21 shown in FIG. 2, the part not covered with the sheet 22 is exposed to gasoline and thus the copper makes the gasoline oxidize. Though the oxidized gasoline does not promote the wear of the sheets 22, it badly influences copper parts which are subjected to the passage of the gasoline.

Figure 3:
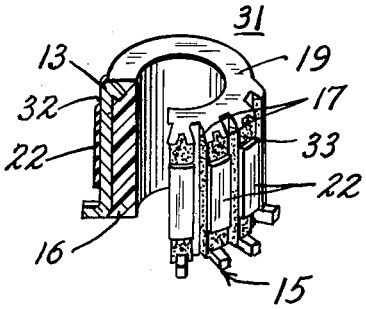
FIG. 3 is a perspective view of a commutator in the second embodiment of the present invention.

FIG. 3 is a perspective view showing a commutator in another embodiment of the present invention. The commutator 31 has an electroplating of metal 33, which does not oxidize gasoline, on the copper surface 32. Metal which does not oxidize gasoline is, for example, silver or tin.

Because the copper surface 32 is covered with the electroplating 33, no part of the commutator 31 oxidizes gasoline. Thus the bad influence as abovementioned can be prevented.

Each sheet 22 is fixed to that part of the surface of the commutator segment 18 contacted by a brush. There are many methods of fixing the sheets. In a method easily thought out, small sheets blanked into a suitable size are fixed to the surface of each commutator segment one by one by means of silver-alloy brazing. This method, however, is time-consuming.

Figure 4A:
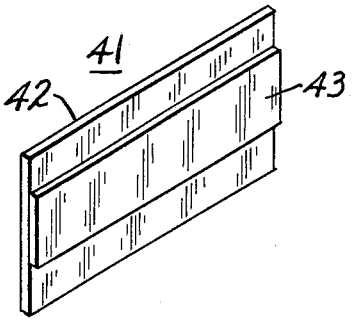
FIGS. 4A and 4B are views for use in explaining one step of the method of the present invention.
Figure 4B:
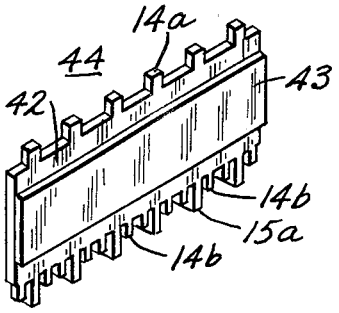

FIGS. 4A and 4B show an efficient fixing method, incorporated into a main step in the production of the commutator shown in FIG. 2. In FIG. 4A, a plate 41 is prepared by previously fixing a sheet 43 of silver or silver alloy to a thin copper plate 42 by means of pressure welding. The pressure-welded plate 41 is blanked into a shape 44 as shown in FIG. 4B. The blanked plate 44 is treated as shown in FIGS. 1B and 1C, and becomes the commutator 21. When slits are provided, the sheet 43 of silver or silver alloy is split into a suitable number of fixed sheets 22.

Figure 5A:
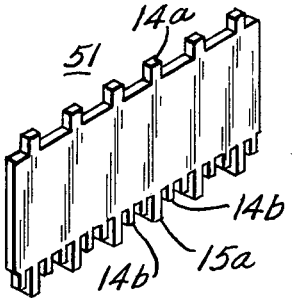
FIGS. 5A and 5B are views for use in explaining other fixing method.
Figure 5B:
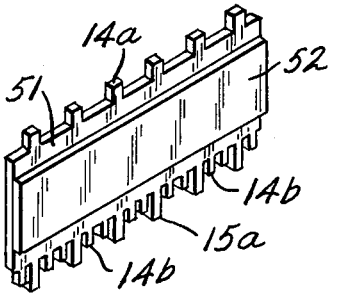

FIGS. 5A and 5B show another fixing method. A plate 51 of FIG. 5A is the same as the blanked copper plate 12 of FIG. 1A. As shown in FIG. 5B, a sheet 52 of silver or silver alloy is fixed to the surface of the plate 51 at the central part thereof by means of silver-alloy brazing. The width of the sheet 52 is a little wider than the width of a brush. The sheet 52 becomes the fixed sheets 22 through the same processes as those explained with reference to FIG. 4B.

Figure 6:
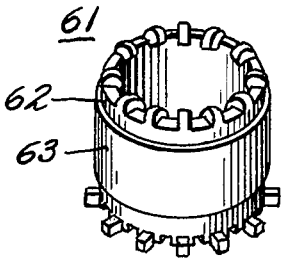
FIG. 6 is a perspective view of a copper cylinder with a silver cylinder fixed thereto by means of silver-alloy brazing.

FIG. 6 shows other fixing method. A cylinder 61 of FIG. 6 is similar to the cylinder 13 shown in FIG. 1B. A cylinder 63, formed by rounding a sheet of silver or silver alloy, is brazed to the outer surface of a cylinder 62, formed by rounding a thin copper plate. Thereafter, slits are provided on the cylinder 61, and then the cylinder 63 is split into a suitable number of fixed sheets 22.

Electroplating 33 as shown in FIG. 3 may be provided on the copper surface of a commutator before providing slits. It is also possible to provide the electroplating after providing the slits. However, if the slits are provided after the copper surface has been plated, copper is exposed at the slits.

Figure 7:
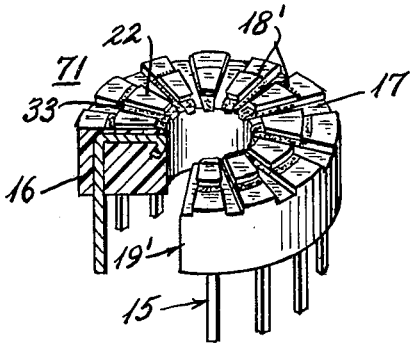
FIG. 7 is a perspective view of a commutator in the fourth embodiment of the present invention.

FIG. 7 shows the embodiment in which the present invention is applied to a flat commutator. The commutator 71 is essentially the same as the commutator 31 shown in FIG. 3 except that the commutator segments 18' are radially arranged on a plane intersecting substantially at a right angle to the axis of the commutator sleeve 19'. Namely, the sheets 22 are fixed to the parts of the surface of the radially arranged commutator segments 18' contacted by brushes, and the electroplating 33 is provided on the surface of each commutator segment 18' not covered by the sheets 22. Functions and effects of the sheets 22 and the electroplating are just the same as those of the commutators as abovementioned.

Figure 8A:
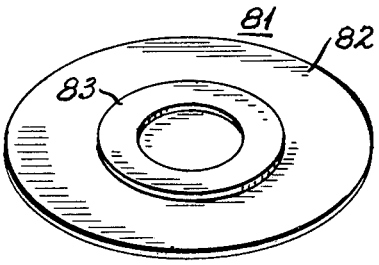
FIGS. 8A and 8B are perspective views for use in explaining one example in the method of producing a flat commutator.
Figure 8B:
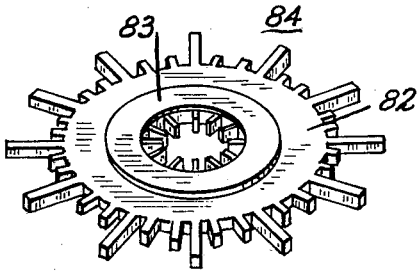

The method of producing the flat commutator is not essentially different from the method described with reference to FIGS. 4A and 4B and FIGS. 5A and 5B. FIGS. 8A and 8B show the method corresponding to the method shown in FIGS. 4A and 4B. In FIG. 8A, a disk 81 is prepared by previously pressure-welding a sheet disk 83 made of silver or silver alloy onto a thin plate disk 82 made of copper. They have circular holes at the center thereof and are concentrically welded. The pressure-welded disk 81 is blanked into a disk 84 of the shape shown in FIG. 8B. As apparent from FIG. 7, pawls and projections of the disk 84 are bent downwardly, a resin cylinder 16 is made under the lower surface of the disk 84 by means of compression molding, and a suitable number of slits are provided radially on the upper surface of the cylinder at regular intervals so that the disk 84 is split into a plurality of radially and annularly arranged commutator segments 18'.

Figure 9A:
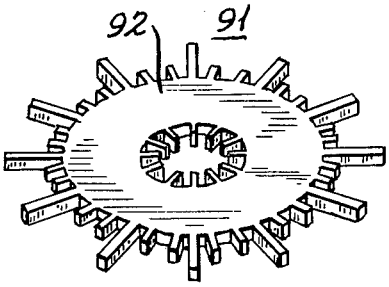
FIGS. 9A and 9B are perspective views for use in explaining another example in the method of producing a flat commutator.
Figure 9B:
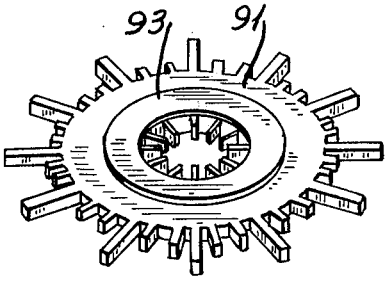

FIGS. 9A and 9B show the method corresponding to the method shown in FIGS. 5A and 5B. A disk 91 shown in FIG. 9A is obtained by blanking a thin copper plate 92 into a disk with a circular hole at the center thereof, a plurality of pawls at the inner and outer peripheries thereof, and a plurality of projections between the pawls disposed at the outer periphery of the disk. As shown in FIG. 9B, a sheet disk 93, made of silver or silver alloy and having a circular hole at the center thereof, is fixed concentrically to the upper surface of the disk 91 by means of silver-alloy brazing. As apparent from FIG. 7, the processes of producing a commutator from the disk 91, having the sheet disk 93 brazed thereto, are the same as those described with reference to FIGS. 8A and 8B.

The present invention has been described with respect to a commutator of a motor to drive a fuel pump which is exposed to gasoline. The present invention is, however, not limited to that type of commutators, but also is applicable to other type of commutators which are used in other liquid or gas to decrease the wear of the commutator. The effect of such commutators does not really differ from that described above.

I claim:

1. A commutator submergeable in gasoline during use and comprising:

a cylinder of an insulating material;

a plurality of copper segments fixed to the peripheral surface of said cylinder extending in the direction parallel with the center axis of said cylinder and arranged spaced apart from one another along the peripheral surface of said cylinder, each of said segments including a riser-forming projection which extends outwardly of said cylinder and a claw-forming projection which is at least partially embedded in said cylinder;

a brush-contact sheet of a first gasoline-resistant material provided on each of said segments; and a cover layer of a second gasoline-resistant material provided to cover the exposed surface of each of said segments where not covered by said brush-contact sheet.

2. A commutator as in claim 1 wherein the insulating material forming said cylinder is a resin.

3. A commutator as in claim 1 wherein said first gasoline-resistant material is selected from the group consisting of silver, a silver and palladium alloy, a silver and nickel alloy, and an alloy of silver, palladium and other metals.

4. A commutator as in claim 1 wherein said brush-contact sheet is 0.4–1.2 mm thick.

5. A commutator as in claim 4 wherein said brush-contact sheet is made of silver.

6. A commutator as in claim 1 wherein said cover layer is formed by electroplating.

7. A commutator as in claim 6 wherein said second gasoline-resistant material is selected from the group consisting of silver and tin.

8. A commutator submergeable in gasoline during use and comprising:

a disk of an insulating material, said disk being provided with a center hole;

a plurality of copper segments disposed on one side surface of said disk and arranged to extend radially from the center of said disk, each of said segments comprising a riser-forming projection which extends in a direction opposite to the surface where said segments are disposed and a claw-forming projection which is at least partially embedded in said disk;

a brush-contact sheet of a first gasoline-resistant material provided on each of said segments; and a cover layer of a second gasoline-resistant material provided to cover the exposed surface of each of said segments where not covered by said brush-contact sheet.

9. A commutator as in claim 8 wherein the insulating material forming said disk is a resin.

10. A commutator as in claim 8 wherein said first gasoline-resistant material is selected from the group consisting of silver, a silver and palladium alloy, a silver and nickel alloy, and an alloy of silver, palladium and other metals.

11. A commutator as in claim 8 wherein said brush-contact sheet is 0.4–1.2 mm thick.

12. A commutator as in claim 11 wherein said brush-contact sheet is made of silver.

13. A commutator as in claim 8 wherein said cover layer is formed by electroplating.

14. A commutator as in claim 13 wherein said second gasoline-resistant material is selected from the group consisting of silver and tin.

* * * * *